US006410092B1

(12) United States Patent
Yang et al.

(10) Patent No.: US 6,410,092 B1
(45) Date of Patent: Jun. 25, 2002

(54) AUTODEPOSITION POST-BATH RINSE PROCESS

(75) Inventors: Zhiqi Yang, Troy; William E. Fristad, Rochester Hills, both of MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/557,534

(22) Filed: Apr. 25, 2000

Related U.S. Application Data

(60) Provisional application No. 60/135,304, filed on May 21, 1999.

(51) Int. Cl.[7] ..... B05D 3/10; B05D 3/02

(52) U.S. Cl. ..... 427/340; 427/341; 427/386; 427/388.4; 427/410; 427/435

(58) Field of Search ..... 427/340, 341, 427/386, 388.4, 410, 435

(56) References Cited

U.S. PATENT DOCUMENTS

| | | | | | |
|---|---|---|---|---|---|
| 3,063,877 | A | | 11/1962 | Schiffman | 148/6.16 |
| 3,585,084 | A | | 6/1971 | Steinbrecher et al. | 148/6.2 |
| 3,592,699 | A | | 7/1971 | Steinbrecher et al. | 148/6.2 |
| 3,647,567 | A | | 3/1972 | Schweri | 148/6.15 |
| 3,791,431 | A | | 2/1974 | Steinbrecher et al. | 148/6.2 |
| 3,795,546 | A | | 3/1974 | Hall et al. | 148/6.2 |
| 4,030,945 | A | | 6/1977 | Hall et al. | 148/6.2 |
| 4,180,603 | A | | 12/1979 | Howell, Jr. | 427/353 |
| 4,186,219 | A | | 1/1980 | Hall | 427/8 |
| 4,186,226 | A | | 1/1980 | Smith | 427/340 |
| 4,233,197 | A | | 11/1980 | Howell, Jr. | 260/29 |
| 4,289,826 | A | | 9/1981 | Howell, Jr. | 428/418 |
| 4,351,675 | A | | 9/1982 | Guhde | 148/6.15 |
| 4,414,350 | A | * | 11/1983 | Hall | 524/320 |
| 4,636,264 | A | * | 1/1987 | Schellenberg et al. | 148/6.2 |
| 4,636,265 | A | * | 1/1987 | Fischer et al. | 148/6.15 R |
| 4,647,480 | A | | 3/1987 | Ahmed | 427/341 |
| 4,800,106 | A | | 1/1989 | Broadbent | 427/388.4 |
| 5,164,234 | A | | 11/1992 | Siebert | 427/419 |
| 5,248,525 | A | | 9/1993 | Siebert | 427/337 |
| 5,294,265 | A | * | 3/1994 | Gray et al. | 148/250 |
| 5,342,694 | A | | 8/1994 | Ahmed et al. | 428/461 |
| 5,372,853 | A | | 12/1994 | Roberto | 427/337 |
| 5,427,863 | A | | 6/1995 | Siebert | 428/463 |
| 5,458,678 | A | | 10/1995 | Armstrong et al. | 106/14.41 |
| 5,500,460 | A | | 3/1996 | Ahmed et al. | 523/402 |
| 5,667,845 | A | | 9/1997 | Roberto et al. | 427/337 |
| 5,786,030 | A | | 7/1998 | Ahmed et al. | 427/353 |
| 6,033,492 | A | | 3/2000 | Honda et al. | 148/240 |

FOREIGN PATENT DOCUMENTS

| | | |
|---|---|---|
| GB | 1 579307 | 11/1980 |
| WO | WO9 707163 | 2/1997 |

* cited by examiner

*Primary Examiner*—Michael Barr
(74) *Attorney, Agent, or Firm*—Stephen D. Harper

(57) ABSTRACT

The anticorrosive properties of a coating autodeposited on a metal substrate are improved by contacting the autodeposited coating with an aqueous solution of an alkaline earth metal compound such as calcium nitrate prior to curing.

8 Claims, No Drawings

AUTODEPOSITION POST-BATH RINSE PROCESS

This application claims priority of provisional application No. 60/135,304 filed May 21, 1999.

BACKGROUND OF THE INVENTION

1. Field of the Invention

This invention relates to improving the anticorrosive properties of an autodeposition coating by a post-bath rinse using an aqueous solution of an alkaline earth metal compound such as calcium nitrate.

2. Discussion of the Related Art

Over the last few decades, various water-based coatings for metallic surfaces have been developed which are commonly referred to in the field as autodeposition coatings. Such coatings utilize an emulsion (latex) or dispersion of a resin capable of forming a protective coating when cured. The coating typically is applied by immersing the metallic surface in a bath containing the resin emulsion or dispersion, acid, and an oxidizing agent to form an adherent coating that is initially wet. The thickness of the coating can be affected, for example, by such factors as total solids, pH and oxidant concentration. Further, the coating thickness is a function of the immersion time. The initial wet coating is sufficiently adherent to remain attached to the surface on which it is formed against the influence of normal gravity and, if desired, can be rinsed before being cured (i.e., converted to a dry, solid and even more adherent coating) by heating. However, a coating produced in this manner does not always provide adequate resistance against corrosion for the metal substrate, as determined, for example, by standard salt spray tests.

The corrosion resistance of certain autodeposited coatings is significantly improved by rinsing the adhered coating, prior to curing, in an aqueous solution containing chromium ions. Appreciable chromium ion concentrations are required to give acceptable coatings. The chromium rinse step is undesirable from an economic and environmental perspective, since chromium compounds are generally both expensive and highly toxic.

The abovedescribed autodeposition coating compositions and coating and rinsing procedures are more fully described in U.S. Pat. Nos. 3,063,877; 3,585,084; 3,592,699; 3,647,567; 3,791,431; 4,030,945; 4,186,226; 3,795,546; 4,636,265; 4,636,264; and 4,800,106, each of which is incorporated herein by reference in its entirety.

From the present state of the art, as above-described, it will be appreciated that there is a need for coating methods capable of producing adherent metal coatings possessing satisfactory corrosion resistance properties without requiring a rinse step where a chromium-containing solution is utilized.

SUMMARY OF THE INVENTION

In one embodiment of the invention, a method for improving the anticorrosive properties of a resin autodeposited on a metal substrate is provided, said method comprising (a) contacting said metal substrate with an autodeposition bath containing said resin in uncured emulsion or dispersion form and an autodeposition activator until a layer of the resin of desired thickness is autodeposited on said metal substrate;

(b) rinsing said metal substrate having the layer of resin autodeposited thereon with a chromium-free aqueous solution containing an anticorrosive effective amount of a water-soluble alkaline earth metal compound; and (c) curing the layer of resin autodeposited on said metal substrate following rinsing step (b).

Specific preferred and/or illustrative embodiments of the invention are as follows:

The foregoing method wherein the water-soluble alkaline earth metal compound is a calcium compound.

The foregoing method wherein the water-soluble alkaline earth metal compound is a nitrate compound.

The foregoing method wherein the water-soluble alkaline earth metal compound is calcium nitrate.

The foregoing method wherein said resin comprises an epoxy resin.

The foregoing method wherein step (b) is performed at a temperature of from about 20° C. to about 100° C.

The foregoing method wherein the aqueous solution has a concentration of the water-soluble alkaline earth metal compound of from about 0.1 to about 5 percent by weight.

In another embodiment, this invention provides a method for improving the anticorrosive properties of a resin comprising an epoxy resin autodeposited on a metal substrate, said method comprising (a) contacting said metal substrate with an autodeposition bath containing said resin in emulsion form and an autodeposition activator until a layer of the resin of desired thickness (typically, about 5 to about 40 micrometers) is autodeposited on said metal substrate;

(b) rinsing said metal substrate having the layer of resin autodeposited therein with a chromium-free aqueous solution containing from about 0.1 to about 5 weight percent of calcium nitrate at a temperature of about 20° C. to about 100° C. for a time effective to improve the anticorrosive properties of the resin; and (c) curing the layer of resin autodeposited on said metal substrate following rinsing step (b).

The process described herein does not require the use of chromium compounds of any type, yet furnishes coatings which effectively protect metallic substrates against corrosion.

DETAILED DESCRIPTION OF THE INVENTION

Metal substrates which can be better protected against corrosion by application of the process of this invention comprise iron, tin, nickel, lead, chromium, zinc, aluminum, or alloys thereof, especially steel (e.g., cold rolled steel, galvanized steel), as well as surfaces which have been coated with one of said metals or its alloys.

The organic resins to be autodeposited on the surfaces of the metal substrates may include a variety of resin materials in emulsion (latex) or dispersion form as known from numerous publications. Resins based on epoxy resins such as glycidyl ethers of polyhydric phenols (e.g., bisphenol A) are particularly suitable for use in the present invention. The epoxy resin emulsions, in addition to one or more epoxy resins, may contain cross-linkers, curatives, emulsifiers, coalescing solvents, accelerator components, and the like. Such epoxy resin-based autodeposition coating systems are described, for example, in U.S. Pat. Nos. 4,233,197; 4,180,603; 4,289,826; and 5,500,460 and in international Publication No. WO 97/07163 (corresponding to U.S. Serial. No. 60/002,782, filed Aug. 16, 1995), the teachings of each of which are incorporated herein by reference in their entirety. It is believed that other suitable resins may include polyethylene, polyacrylates, styrene-butadiene copolymers, phenolic and novolac resins, urethanes, polyesters, vinyl chloride homo- and copolymers, vinylidene chloride homo- and copolymers and the like, although the alkaline earth metal compound, concentration and rinse temperature may have to be varied from what is described in the Examples section hereof in order for the corrosion resistance of the resulting coatings to be effectively improved.

For the actual coating procedure, the resin is autodeposited according to known methods on metal surfaces which preferably have been chemically and/or mechanically cleaned in the conventional manner. This type of process is described in U.S. Pat. Nos. 3,791,431; 4,186,219 and 4,414,350, all of which are incorporated herein by reference in their entirety, as well as in many other patents. If desired, the uncured coatings may be rinsed with water alone immediately after the actual coating step.

The alkaline earth metal compound used in the rinsing step must be soluble in water. Preferably, the alkaline earth metal portion of such compound is calcium. Preferably, the anion portion of such compound is nitrate. Calcium nitrate, for reasons which are not well understood, has been found to be especially effective in improving the corrosion resistance of autodeposited coatings. Illustrative examples of other suitable compounds include calcium chloride, calcium acetate, calcium formate, barium nitrate, barium acetate, and magnesium benzoate. Mixtures of alkaline earth metal compounds may be used. The alkaline earth compound need not be of high purity; technical or industrial grade materials can often be employed, provided the impurities present do not interfere with the development of the desired anticorrosion properties of the cured coating. For example, the calcium nitrate granules sold under the designation Norsk Hydro CN by Norsk Hydro, which contain about 80% calcium nitrate, 10% ammonium nitrate, 1% strontium nitrate and 15% water, have been found to be quite effective in the rinse process described herein when dissolved in water.

While not necessary to obtain significant improvement in corrosion resistance, other substances besides the alkaline earth metal compound(s) could be present in the aqueous rinse. A major advantage of the present invention is that there is no need to use chromium compounds in the rinse.

Although the concentration of the alkaline earth metal compound in the rinse solution is not believed to be particularly critical, an amount must be present which is sufficient to enhance the resistance of the resulting substrate towards corrosion. This minimum amount will vary depending upon the resin composition used, the alkaline earth metal compound selected, the rinse temperature, duration of rinsing, and the like, but may be readily determined through minimal experimentation. Typically, concentrations of from about 0.1 to about 5 percent by weight will suffice. Generally speaking, better corrosion resistance is obtained as the alkaline earth metal compound concentration in the rinse solution is increased. However, resistance to brake fluid and solvents and the appearance of the coating may be adversely affected at high alkaline earth metal compound levels.

The metal substrate autodeposition-coated with the uncured resin as described above is contacted with the rinse solution containing the alkaline earth metal compound according to known methods. For example, the metal substrates may be immersed or dipped in the rinse solution, spray-treated with the solution, roll-coated, or treated with a combined spray/dip procedure. Multiple rinses may be performed if so desired. The duration of treatment typically is from a few seconds to a few minutes, with a period of from about 30 seconds to about 5 minutes being preferred. During said treatment, the alkaline earth metal compound solution is generally maintained at a temperature of from about 20° C. to about 100° C. In at least certain embodiments of the invention, coating edge coverage is generally improved by increasing the rinse temperature from room temperature to about 50 degrees C. Typically, however, higher alkaline earth metal compound concentrations are needed at higher rinse temperatures.

Following the rinsing step, the coated metal substrates may be cured. Generally speaking, further rinsing with water alone is not desirable since such rinsing tends to degrade the improvements in corrosion resistance obtained by the alkaline earth metal compound rinse. Curing may be performed in any known manner, for example by heating (preferably baking) at an elevated temperature (e.g., about 50° C. to about 300° C.). The selection of the particular curing temperature will depend upon the type of resin, cross-linking agent, and coalescent used for the coating, among other factors.

EXAMPLES

An epoxy dispersion containing epoxy resins, cross-linker, coalescing solvent, and surfactant having a particle size range of 100 to 300 nm was prepared in accordance with the procedures described in International Publication Number WO 97/07163 (corresponding to U.S. Patent Serial No. 60/002,782, filed Aug. 16, 1995).

ACT CRS (cold rolled steel) panels were cleaned with a conventional alkaline cleaner and rinsed with water prior to being coated using a bath of the above-described epoxy dispersion. The cleaned panels were immersed in the coating bath at ambient temperature for about 90 seconds. The coating bath contained 15 wt % of the epoxy dispersion (about 6% bath solids), 0.1 8 wt % ferric fluoride, 0.23 wt % hydrofluoric acid, 0.52 wt % carbon black (AQUABLACK 255A), and 84.07 wt % deionized water. The uncured film was first rinsed in a tap water bath, then immersed in the reaction rinse for 1 minute. Rinse temperature was varied from in ambient to 50° C. The coated, rinsed panels were then cured at 185° C. for 40 minutes.

The cured coating panels were subjected to NSS (Neutral Salt Spray) testing (ASTM B-117) for 240 hours and 336 hours exposure, whirlpool detergent #T-18 testing for 48 hours, ASTM D870 water soak testing for 240 hours, and GM 9511P cyclic corrosion testing for 20 cycles.

Table 1 shows that the resistance of the coating to salt spray is dramatically improved when the panel is rinsed with a calcium nitrate solution at ambient temperature, as compared to a control using a deionized (DI) water rinse. Under these conditions, 0.1 wt % calcium nitrate was as effective as 1.0 wt % calcium nitrate.

TABLE 1

| Reaction Rinse Composition | 336 Hr. NSS Total Scribe Creepage, mm |
|---|---|
| Deionized Water (Control) | 11 |
| 0.1 wt % Calcium Nitrate | 2.5 |
| 1.0 wt % Calcium Nitrate | 2.5 |

Table 2 shows the effect of alkaline earth metal compound concentration on corrosion resistance, using a reaction rinse temperature of 50±2° C. For this particular epoxy resin-based autodeposited coating, the optimum concentration art under these conditions was found to be in the range of greater than 0.1 wt % up to 3 wt %. Without wishing to be bound by theory, it is believed that higher concentrations are required at higher bath temperatures because the coating film adhered to the panel contains less water (and therefore a lower amount of the alkaline earth metal compound).

TABLE 2

| Reaction Rinse Composition | 336 Hr. NSS Total Scribe, mm | 48 Hr. Detergent Test Total Scribe, mm | 10 Cycles GM 9511P Test Total Scribe, mm | Tape Adhesion Test After 240 Hr. Water Soak* |
|---|---|---|---|---|
| Deionized Water (Control) | 10 | 9.5 | >20 | 0B |
| 0.01 wt % $Ca(NO)_2$ | 12 | 3 | 22.3 | 4B |
| 0.05 wt % $Ca(NO_3)_2$ | 9.5 | 5 | N/A | 5B |
| 0.1 wt % $Ca(NO_3)_2$ | 9 | 6 | 21.6 | 5B |
| 0.25 wt % $Ca(NO_3)_2$ | 5.2 | 3 | N/A | 5B |
| 0.75 wt % $Ca(NO_3)_2$ | 3.8 | 0 | 16.2 | 5B |
| 1.00 wt % $Ca(NO_3)_2$ | 2.8 | N/A | N/A | N/A |
| 2.00 wt % $Ca(NO_3)_2$ | N/A | 0 | 8.6 | 4B |
| 3.00 wt % $Ca(NO_3)_2$ | 2.3 | N/A | N/A | N/A |

N/A = data not available
*5B = 100% adhesion
0B = >60% loss

A number of other compounds were screened for activity in enhancing the corrosion resistance of the epoxy-based autodeposited coating using 1 wt % solutions in water, as shown in Table 3. Under the test conditions employed, calcium nitrate was the most effective compound although barium nitrate also worked well. Certain other calcium compounds also provided significant improvement over the control (deionized water).

TABLE 3

| Reaction Rinse Composition | Rinse Temperature, ° C. | 336 Hr. NSS Total Scribe, mm |
|---|---|---|
| Deionized Water (Control) | 50 | 10 |
| Nitric Acid | 25 | 12.5 |
| Ammonium Nitrate | 40 | 9.2 |
| Calcium Chloride | 50 | 7.2 |
| Calcium Acetate | 50 | 6.2 |
| Calcium Formate | 50 | 5.5 |
| Calcium Propionate | 50 | 20% delamination |
| Calcium Nitrate | 50 | 3 |
| Barium Nitrate | 50 | 4.8 |
| Barium Acetate | 50 | 7.2 |
| Magnesium Benzoate | 50 | 6.8 |
| Magnesium Acetate | 50 | 10.5 |
| Magnesium Thiosulfate | 50 | 9 |
| Magnesium Molybdate | 50 | 17 |
| Magnesium Formate | 50 | 11.5 |
| Magnesium Sulfate | 50 | 25 |
| Magnesium Bisulfite | 50 | 25 |
| Magnesium Sulfate, Anhydrous | 50 | 21 |
| Magnesium Citrate, Tribasic USP | 50 | 20 |

Preliminary experiments using panels coated with either a PVDC resin-based autodeposition coating or a polyacrylic resin-based autodeposition coating found that rinsing such panels with 1% aqueous calcium nitrate solutions had little or no effect on corrosion resistance. It is believed, however, that improvements in corrosion resistance for such coatings could be attained by varying the alkaline earth metal compound selected, the concentration of said compound in the rinse solution, and/or the temperature of the rinse solution.

What is claimed is:

1. A method of improving the corrosion resistance of a metallic surface, said method comprising a) contacting said metallic surface with an autodeposition bath comprising a resin in uncured emulsion or dispersion form and an autodeposition activator until a layer of the resin of desired thickness is autodeposited on said metallic surface;

b) rinsing said metallic surface having the layer of resin autodeposited thereon with a chromium-free aqueous solution comprising an anticorrosive effective amount of at least one water-soluble alkaline earth metal compound selected from the group consisting of calcium nitrate, calcium chloride, calcium acetate, calcium formate, barium nitrate, barium acetate, and magnesium benzoate; and c) curing the layer of resin autodeposited on said metallic surface, wherein said layer of resin autodeposited on said metallic surface is not contacted with any chromium compound and is not rinsed with water alone after the rinsing step b) and before said curing.

2. The method of claim 1 wherein at least one water-soluble alkaline earth metal compound is a calcium compound.

3. The method of claim 1 wherein at least one water-soluble alkaline earth metal compound is a nitrate compound.

4. The method of claim 1 wherein at least one water-soluble alkaline earth metal compound is calcium nitrate.

5. The method of claim 1 wherein the resin comprises at least one epoxy resin.

6. The method of claim 1 wherein said rinsing step (b) is performed at a temperature of from about 20° C. to about 100° C.

7. The method of claim 1 wherein the aqueous solution has an alkaline earth metal compound concentration of from about 0.1 to about 5 percent by weight.

8. A method for improving the anticorrosive properties of a resin comprising an epoxy resin autodeposited on a steel substrate, said method comprising a) contacting said metallic substrate with an autodeposition bath comprising said resin in emulsion or dispersion form and an autodeposition activator until a layer of the resin of desired thickness is autodeposited on said steel substrate;

b) rinsing said steel substrate having the layer of resin autodeposited thereon with a chromium-free aqueous solution comprising from about 0.1 to 5 by weight percent of calcium nitrate at a temperature of about 20° C. to about 100° C. for a time effective to improve the anticorrosive properties of the resin; and c) curing the layer of resin autodeposited on said steel substrate following rinsing step (b), wherein said layer of resin autodeposited on said steel substrate is not contacted with any chromium compound and is not rinsed with water alone after the rinsing step b) and before said curing.

* * * * *